US009282809B2

(12) United States Patent
McCurdy

(10) Patent No.: US 9,282,809 B2
(45) Date of Patent: Mar. 15, 2016

(54) EARBUD HOLDER FOR A BELT

(71) Applicant: William Alexander McCurdy, Caledonia, MI (US)

(72) Inventor: William Alexander McCurdy, Caledonia, MI (US)

(73) Assignee: BLUCASE, LLC, Kentwood, MI (US)

( * ) Notice: Subject to any disclaimer, the term of this patent is extended or adjusted under 35 U.S.C. 154(b) by 119 days.

(21) Appl. No.: 14/219,254

(22) Filed: Mar. 19, 2014

(65) Prior Publication Data

US 2015/0265036 A1 Sep. 24, 2015

(51) Int. Cl.
*A45F 5/02* (2006.01)
*H04R 1/10* (2006.01)

(52) U.S. Cl.
CPC ..... *A45F 5/021* (2013.01); *H04R 1/1033* (2013.01)

(58) Field of Classification Search
CPC ..... A45F 5/004; B65H 75/241; H04R 1/1033
USPC ..... 224/235, 654, 162; 206/702; D8/356; D14/223; D03/218; 242/160.3, 364.12, 242/366.2
See application file for complete search history.

(56) References Cited

U.S. PATENT DOCUMENTS

| | | | | |
|---|---|---|---|---|
| 3,136,415 | A * | 6/1964 | Sandstrom | A61F 15/002 206/403 |
| D491,364 | S * | 6/2004 | Vish | D3/218 |
| 7,121,501 | B1 * | 10/2006 | Lea | B65H 75/14 242/608.2 |
| D612,595 | S * | 3/2010 | McCurdy | D3/218 |
| 2005/0198882 | A1 * | 9/2005 | Zaremba | A47G 1/06 40/654.01 |
| 2007/0272686 | A1 * | 11/2007 | Yu | A45C 11/00 220/4.02 |
| 2008/0217369 | A1 * | 9/2008 | Sloot | A61F 5/0104 224/222 |
| 2009/0095751 | A1 * | 4/2009 | Hamlin | A45C 13/1069 220/230 |
| 2010/0012696 | A1 * | 1/2010 | Prager | B62J 9/005 224/417 |
| 2010/0071168 | A1 * | 3/2010 | Miller | A45F 5/02 24/3.11 |

* cited by examiner

*Primary Examiner* — Justin Larson
*Assistant Examiner* — Scott McNurlen
(74) *Attorney, Agent, or Firm* — Justin Lampel

(57) ABSTRACT

An earbud holder for a belt is provided. The earbud may be a speaker, headphone or the like for allowing a user to hear an audio transmission. The earbud holder moves from a closed First Position A to an open Second Position B so as to allow a user to open and store an earbud. The earbud holder has a front panel and a back panel wherein the front panel moves with respect to the back panel and wherein magnets secure the earbud holder in the closed First Position A. The earbud holder has a generally u-shaped drawer located between the front panel and the back panel for securing the earbud.

12 Claims, 4 Drawing Sheets

EARBUD HOLDER FOR A BELT

BACKGROUND OF THE INVENTION

An earbud holder for a belt is provided. The earbud may be a speaker, headphone or the like for allowing a user to hear an audio transmission. The earbud holder moves from a closed First Position A to an open Second Position B so as to allow a user to open and store an earbud. The earbud holder has a front panel and a back panel wherein the front panel moves with respect to the back panel and wherein magnets secure the earbud holder in the closed First Position A. The earbud holder has a generally u-shaped drawer located between the front panel and the back panel for securing the earbud.

Attempts have been made to provide a holder for earbuds. For example, U.S. Pat. No. D620,781 to Weckworth discloses a unique design for an earbud holder. Further, U.S. Pat. No. 6,006,915 to Moor discloses a substantially pear-shaped case for an audio device, such as a compact disc player, and headphone set, the case formed of a base with side walls extending therefrom to form a compartment tapering inwardly terminating in a narrowed portion distal the base. In combination, the audio device is disposed in substantially upright condition in the compartment of the case while the headphones lie in an inverted substantially upright position with the ear speakers lying in an upper narrowed portion of the case and the curved connecting member arranged in a U-shaped configuration lying in cooperative nesting position with the audio device adjacent the base of the case.

Still further, U.S. Pat. No. 8,311,257 to Hu discloses an earphone mounting structure having an earphone consisting of a flat base frame shell, a speaker, a cover frame shell capped and a detachable decorative cap shell, and a mounting device adapted for securing the earphone to a cap for the head of a person. The mounting device can be formed of a snap fastener, a clamping device, or pads of hook and loop materials, enabling the earphone to be conveniently and detachably fastened to the user's cap.

However, these earbud holders fail to provide an earbud holder having a movable front panel and a stationary back panel wherein the front panel of the earbud holder moves with respect to the back panel of the earbud holder. Further, these patents fail to disclose an earbud holder which may be easily secured to the belt of a user.

SUMMARY OF THE INVENTION

An earbud holder for a belt is provided. The earbud may be a speaker, headphone or the like for allowing a user to hear an audio transmission. The earbud holder moves from a closed First Position A to an open Second Position B so as to allow a user to open and store an earbud. The earbud holder has a front panel and a back panel wherein the front panel moves with respect to the back panel and wherein magnets secure the earbud holder in the closed First Position A. The earbud holder has a generally u-shaped drawer located between the front panel and the back panel for securing the earbud.

An advantage of the present earbud holder for a belt is that the earbud holder has a front panel and a back panel wherein the front panel moves with respect to the stationary back panel.

Yet another advantage of the present earbud holder is that the present earbud holder has a plurality of magnets which allow the front panel of the earbud holder to be temporarily and selectively secured to the back panel of the earbud holder.

Still another advantage of the present earbud holder is that the earbud holder may have a transparent front layer which allows a user to display various fashion designs located on a removable front plate.

Another advantage of the present earbud holder is that the present earbud holder may be glow-in-the-dark so as to allow a user to locate an earbud in diminished light.

Yet another advantage of the present earbud holder is that the present earbud holder may have an interior foam holder which allows for the secure and safe holding of an earbud.

And yet another advantage of the present earbud holder is that the present earbud holder has a u-shaped drawer for securing the earbud.

Still another advantage of the present earbud holder is that the present earbud holder may be secured to a belt via a clip.

And another advantage of the present earbud holder is that the present earbud holder may have a removable belt clip which allows a user to use the holder without the belt clip.

For a more complete understanding of the above listed features and advantages of the present earbud holder for a belt, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

An earbud holder for a belt is provided. The earbud may be a speaker, headphone or the like for allowing a user to hear an audio transmission. The earbud holder moves from a closed First Position A to an open Second Position B so as to allow a user to open and store an earbud. The earbud holder has a front panel and a back panel wherein the front panel moves with respect to the back panel and wherein magnets secure the earbud holder in the closed First Position A. The earbud holder has a generally u-shaped drawer located between the front panel and the back panel for securing the earbud.

Figure 1:
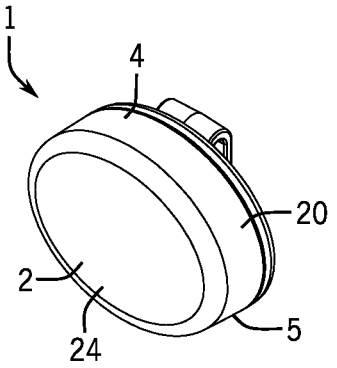
FIG. 1 illustrates a perspective view of the front of the earbud holder wherein the earbud holder is in the closed First Position A.
Figure 2:
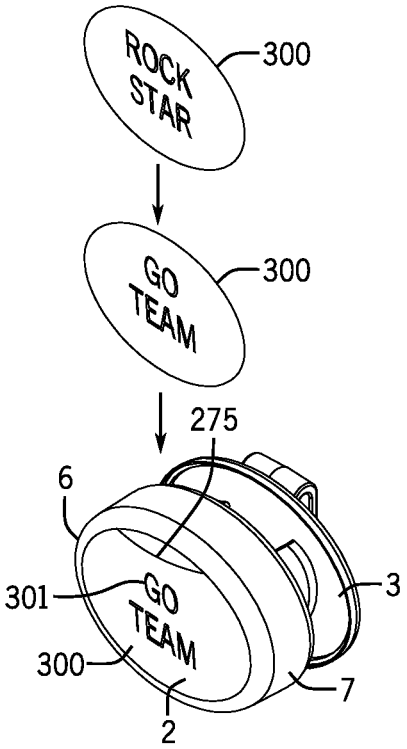
FIG. 2 illustrates a perspective view of the front of the earbud holder wherein the earbud holder is in the open Second Position B.
Figure 5:
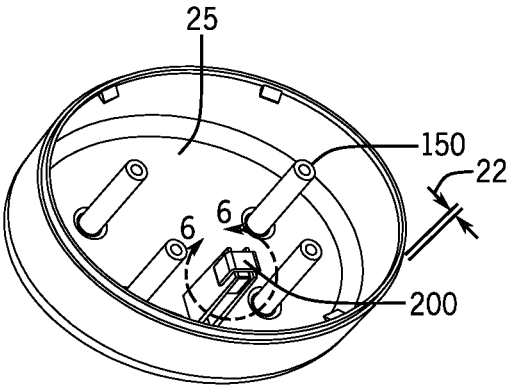
FIG. 5 illustrates a perspective view of the back surface of the front panel of the earbud holder.

Referring now to FIG. 1, an earbud holder 1 is provided. The earbud holder 1 may have a front panel 2, a back panel 3 (FIG. 2), a top 4, a bottom 5, a first side 6, a second side 7 and a generally hollow interior 8 (FIG. 12) wherein an earbud 9 (FIG. 12) may be stored within the interior 8 of the device 1. In an embodiment, the front panel 2 may have a front surface 24 (FIG. 1) and a back surface 25 (FIG. 5). The earbud holder 1 may move from a closed First Position A (FIG. 1) to an open Second Position B (FIG. 2). In the open Second Position B, the front panel 2 is slightly removed from the stationary back panel 3 such that the earbud 9 may be placed in the interior 8 of the device 1. Once inserted into the interior 8 of the device 1, the front panel 2 may be moved back into the closed First Position A and the device 1 will remain closed with the earbud 9 secured within the interior 8.

In an embodiment, the earbud holder 1 may be generally made from a durable plastic, metal or the like. In an embodiment, the earbud holder 1 is made from a glow-in-the-dark material (or painted with glow-in-the-dark paint) such that a user may locate the device 1 (and earbud 9 inside) in diminished light. It should be understood that any suitable material may be used to construct the device 1 as may be required for the desired function of the earbud holder 1. Further, the figures illustrate a generally oval earbud holder 1; however, any suitable shape may be used.

Figure 3:
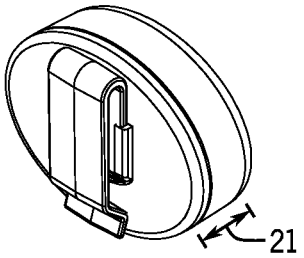
FIG. 3 illustrates a perspective view of the back of the earbud holder.
Figure 4:
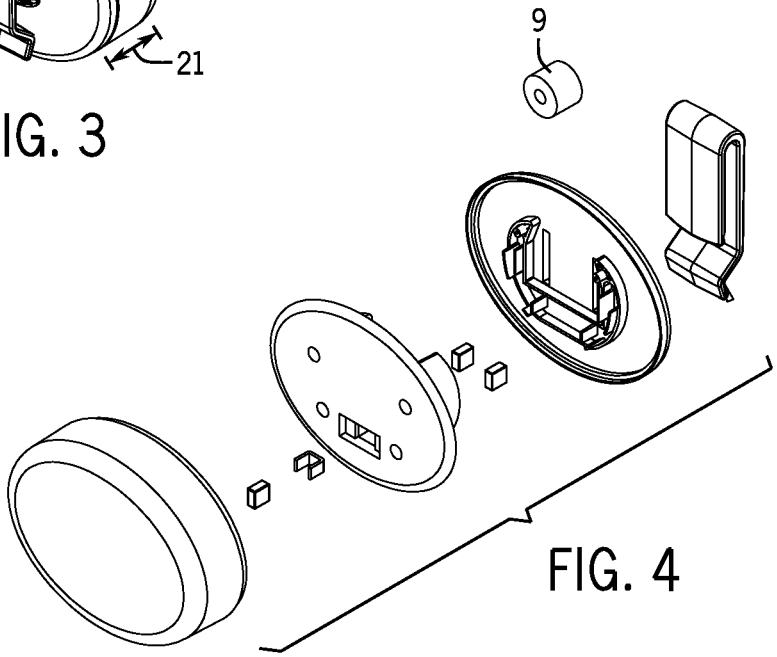
FIG. 4 illustrates an exploded view of the earbud holder.

In an embodiment, the front panel 2 of the earbud holder 1 may have a generally oval extended ridge portion 20. The extended ridge portion 20 may completely surround the front panel 2 of the earbud holder 1. The extended ridge portion 20 may have a width 21 (FIG. 3) and a thickness 22 (FIG. 5). Generally, the width 21 of the extended ridge portion 20 of the front panel 2 is greater than a width 44 (FIG. 12) of the earbud 9 such that the earbud 9 may fit snuggly within the interior 8 of the device 1.

Figure 9:
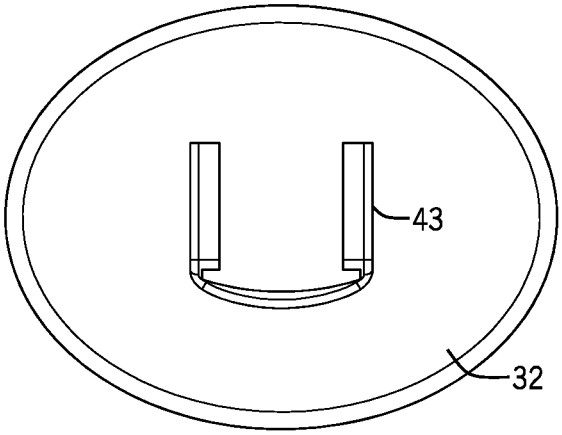
FIG. 9 illustrates a view of the back surface of the back panel of the earbud holder.
Figure 10:
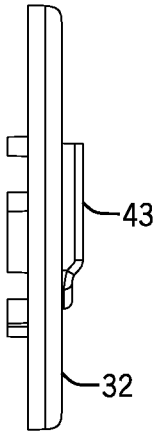
FIG. 10 illustrates a side view of the back panel of the earbud holder.
Figure 12:
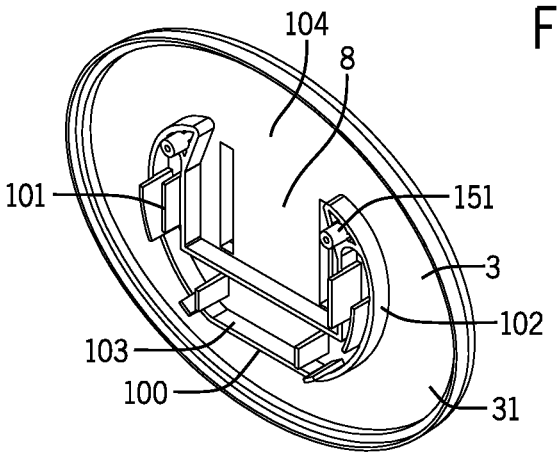
FIG. 12 illustrates a perspective view of the front surface of the back panel of the earbud holder.

Referring now to FIGS. 9 and 12, in an embodiment, the back panel 3 of the earbud holder 1 may have a front surface 31 (FIG. 12) and a back surface 32 (FIG. 9). The front surface 31 of the back panel 3 of the earbud holder 1 may face forward, toward the front panel 2 of the earbud holder 1 whereas the back surface 32 of the back panel 3 may face away from the front panel 2 (and toward the user).

Figure 7:
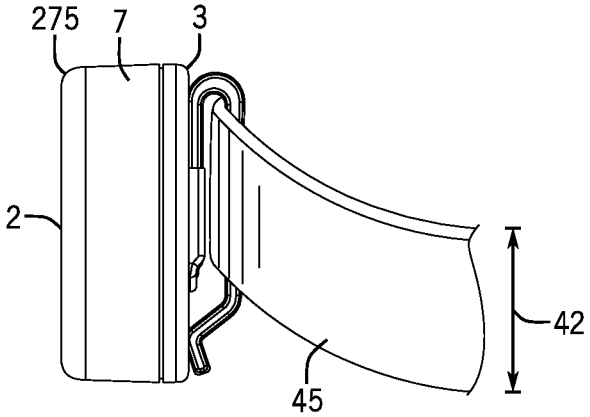
FIG. 7 illustrates a side view of the earbud holder wherein the earbud holder is in the closed First Position A and secured to a belt.
Figure 8:
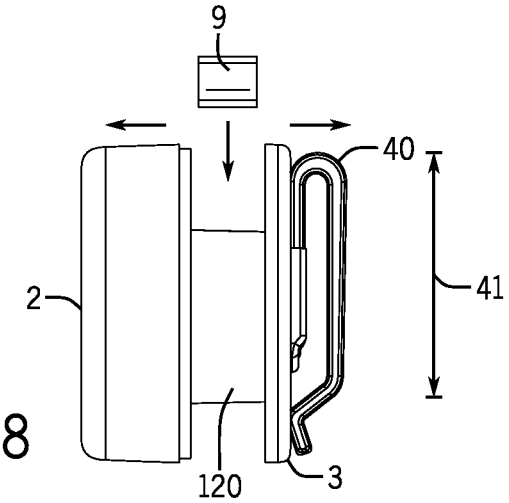
FIG. 8 illustrates a side view of the earbud holder wherein the earbud holder is in the open Second Position B.

In an embodiment, the back surface 32 of the back panel 3 of the earbud holder 1 may have a clip 40 (FIG. 8) which removably secures into a clip receiver 43 (FIG. 9). The clip 40 may have a length 41 which is slightly greater than a width 42 (FIG. 7) of an average belt 45 such that the clip 40 may be partially secured around the belt 45. More specifically, in an embodiment, the clip 40 may be used to secure the earbud holder 1 to a belt 45 so that the earbud holder 1 may be easily worn by a person.

In an embodiment, a user may selectively remove the clip 40 of the device 1 from the clip receiver 43 so as a user may carry the device 1 in, for example, the user's pocket as opposed to wearing the device 1 on a belt 45. Removing the clip 40 from the clip receiver 43 may further allow the device 1 to be carried and stored in a more compact configuration.

Figure 11:
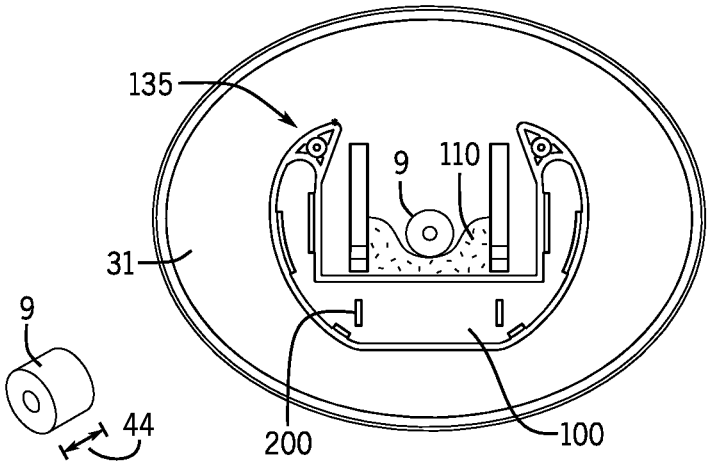
FIG. 11 illustrates a view of the front surface of the back panel of the earbud holder.

Referring now to FIGS. 11 and 12, in an embodiment, the front surface 31 of the back panel 3 of the device 1 may have a generally u-shaped securing holder 100. The u-shaped securing holder 100 may have a first side 101, a second side 102, a bottom 103 and an opening 104 located at the top of the u-shaped holder 100. During use, when the device 1 is in the open Second Position B, the first side 101, second side 102 and bottom 103 of the u-shaped holder 100 may be located between the front panel 2 and the back panel 3 and may allow the earbud 9 to be dropped down through the opening 104 of the top of the u-shaped holder 100 so that the u-shaped holder 100 holds the earbud 9 by, for example, gravity. In an embodiment, a foam securing device 110 (FIG. 11) may be located within the u-shaped holder 100 and may further help secure the earbud 9 within the device 1.

Referring now to FIG. 11, in an embodiment, the first side 101 and the second side 102 of the u-shaped holder 100 may have a tapered portion 135 (located near the top of the u-shaped holder 100). The tapered portion 135 of the first side 101 and the second side 102 may be tapered inward, toward the center of the u-shaped holder 100. The tapered portions 135 may provide a barrier to reduce the chance of the earbud 9 accidently falling out of the u-shaped holder 100 when the device 1 is in the open Second Position B.

Figure 6:
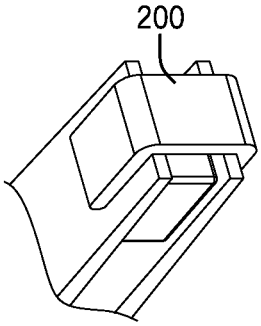
FIG. 6 illustrates a view of the magnets of the earbud holder.

Referring now to FIGS. 5, 6 and 11, in the closed First Position A, the front panel 2 may be secured to the back panel 3 by, for example, a plurality of magnets 200. In particular, a magnet 200 may be located on and secured to the back surface 25 of the front panel 2 and a second magnet 200 having a reversed polarity orientation may be correspondingly secured to the front surface 31 of the back panel 3 such that the front panel 2 remains secured to the back panel 3 in the closed First Position A unless a user pulls on the front panel 2 to overcome the magnetic force; therein allowing the user to open the device 1 into the open Second Position B.

Referring again to FIG. 5, in an embodiment, a plurality of shafts 150 may be located on the back surface 25 of the front panel 2. The figures illustrate four shafts 150; however any number of shafts 150 may be used. The shafts 150 of the back surface 25 of the front panel 2 may be partially secured within shaft receivers 151 (FIG. 12) of the front surface 31 of the back panel 3. The shaft receivers 151 of the back panel 3 may have an opening allowing the shafts 150 to telescopically move forward and backward; therein allowing the front panel 2 to move from the closed First Position A to the open Second Position B and vice versa.

Referring now to FIG. 2, in an embodiment, a removable front plate 300 may be used in association with the device 1. More specifically, an opening slit 275 may be located at the top 4 of the device 1 (at the front panel 2). The opening slit 275 may allow the removable front plate 300 in be inserted between the front panel 2 of the device 1 and a transparent layer 301 such that the removable front plate 300 may be visible through the transparent layer 301 covering the front panel 2 of the device 1. As a result, a user may switch the removable front plate 300 to an alternative removable front plate 300 so as to allow for variable fashions. Preferably, the removable front plate 300 is slightly smaller than the transparent layer 301 so that the removable front plate 300 fits between the transparent layer 301 and the front panel 2, but not too small that the removable front plate 300 shifts substantially between the transparent layer 301 and the front panel 2.

Figure 13:
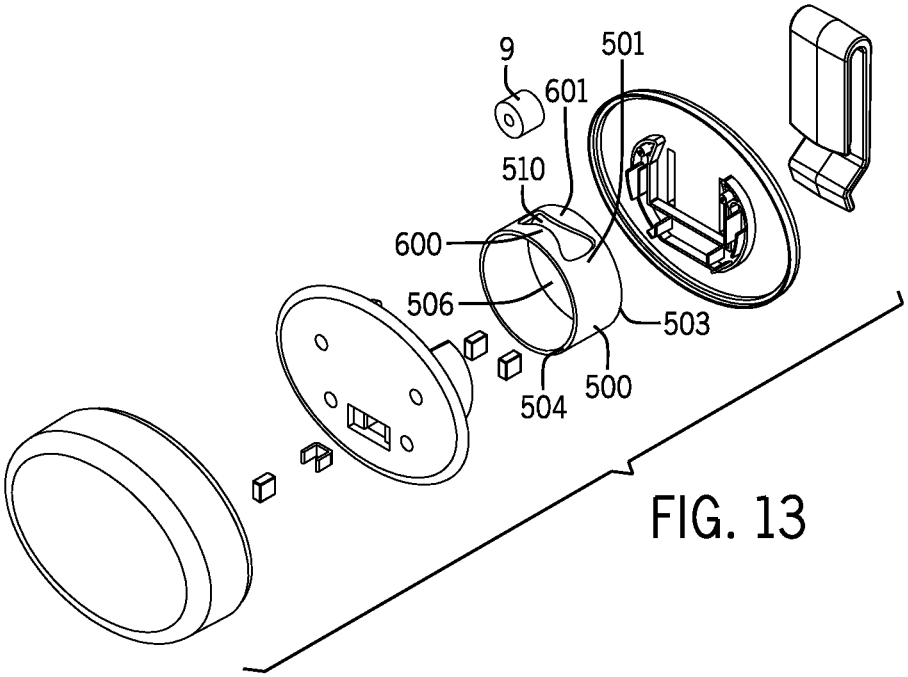
FIG. 13 illustrates an option retainer device used in connection with the earbud holder.

Referring now to FIG. 13, in an embodiment, an optional retainer 500 may be used in connection with the device 1. The optional retainer 500 may have a top 501, a bottom, a front 503, a back 504 and a generally hollow interior. The optional retainer 500 may be generally oval in shape and may have an opening 506 extending through the middle of the optional retainer 500. In an embodiment, the optional retainer 500 may be located between the front panel 2 and the back panel 3. The top 501 of the optional retainer 500 may have an opening 510.

The opening 510 at the top 501 of the optional retainer 500 may be generally bow-tie shaped.

In an embodiment, the optional retainer 500 may generally surround the generally u-shaped securing holder 100. More specifically, the top 501 of the optional retainer 500 may align with the opening 104 at the top of the generally u-shaped securing holder 100. As a result, the earbud 9 may be placed partially within the bow-tie shaped opening 510 of the optional retainer 500.

In an embodiment, the middle section of the optional retainer 500 may have a first and second flap 600, 601. The first and second flap 600, 601 may be generally flexible so as to allow the earbud 9 (which is generally larger than the opening 510) to be inserted into the interior 505 of the optional retainer 500 by slightly displacing the first and/or second flap 600, 601 up or down, inserting the earbud 9 and then allowing the first and second flap 600, 601 to relax. In the relaxed state, the first and second flap 600, 601 are generally parallel and located on the same plane. In the relaxed state, the opening 510 at the top 501 of the optional retainer 500 is too small for the earbud 9 to accidentally falling out of the device 1.

Figure 14:
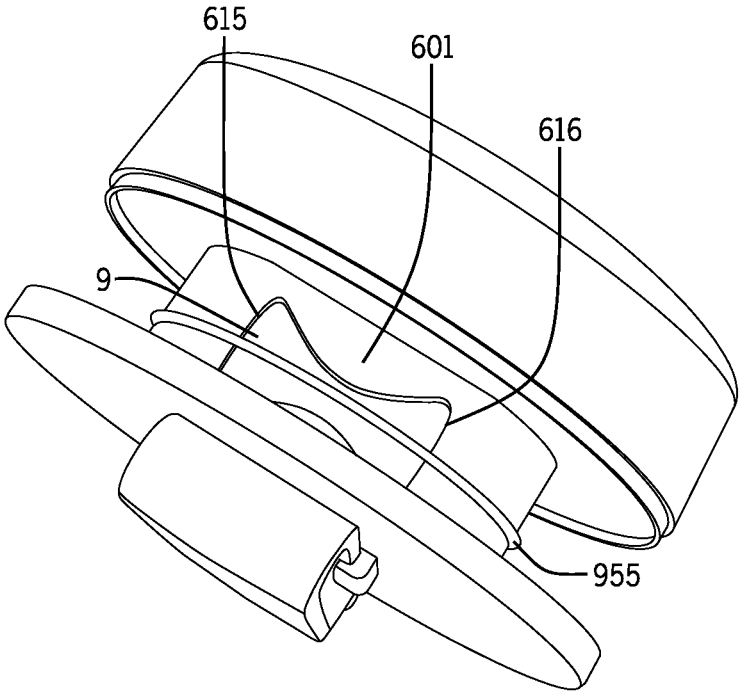
FIG. 14 illustrates a cord partially wrapped around the optional retainer of the device.

Referring now to FIG. 14, in an embodiment the earbud 9 may have an attached cord 955. During use, a user may partially wrap the cord 955 around the optional retainer 500 so as to further prevent the earbud 9 from accidentally becoming removed from the device 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. An earbud holder comprising:

a front panel having a first side, a second side, a top, a bottom, a front and a back;

a back panel having a first side, a second side, a top, a bottom, a front and a back;

a generally u-shaped holder having a first side, a second side and a bottom and an interior and wherein the u-shaped holder is located between the front panel and the back panel;

wherein the front panel moves with respect to the back panel and wherein an earbud is secured within the interior of the u-shaped holder;

a transparent surface having a first side, a second side and a bottom wherein the first side of the transparent surface is connected to the first side of the front panel and wherein the second side of the transparent surface is connected to the second side of the front panel and wherein the bottom of the transparent surface is connected to the bottom of the front panel and wherein a pocket is formed between the transparent surface and the front of the front panel;

a removable plate having an ornamental design wherein the removable plate may be temporarily secured in the pocket created by the transparent surface and the front panel; and a generally oval ring having a top having an opening wherein the generally oval ring is located between the front panel and the back panel and wherein the opening of the top of the generally oval ring allows access to the interior of the u-shaped holder.

2. The earbud holder of claim 1 further comprising:

a first magnet secured to the back of the front panel;

a second magnet secured to the front of the back panel; and wherein the first magnet and the second magnet are of opposite polarity orientation and wherein the first magnet and second magnet temporarily and selectively secures the front panel to the back panel.

3. The earbud holder of claim 1 wherein the front panel, the back panel or the generally u-shaped holder is glow in the dark.

4. The earbud holder of claim 1 further comprising:

a removable clip secured to the back of the back panel wherein the removable clip has a width is slightly greater than the width of a belt and wherein the removable clip allows the earbud holder to be temporarily secured to the belt.

5. The earbud holder of claim 1 further comprising:

a securing device made from foam located within an interior of the generally u-shaped holder wherein the securing device made from foam is molded to receive and temporarily secure the earbud.

6. The earbud holder of claim 1 further comprising:

a tapered edge on the first side and a tapered edge on the second side of the generally u-shaped holder wherein the tapered edge of the first side and the tapered edge of the second side of the generally u-shaped holder taper inward, toward the center of the generally u-shaped holder.

7. The earbud holder of claim 1 further comprising:

a plurality of prongs secured to the back of the front panel; and a plurality of columns having a hollow interior secured to the front of the back panel wherein the plurality of prongs of the front panel telescopingly move within the hollow interior of the plurality of columns of the back panel and allow the front panel to move with respect to the back panel.

8. The earbud holder of claim 1 wherein the front panel and the back panel are generally oval in shape.

9. The earbud holder of claim 1 wherein the generally oval ring has a bottom, a curved side, and a second opening wherein the second opening runs between the top, the bottom and the curved side.

10. The earbud holder of claim 9 further comprising:

a first flap located at the opening at the top of the generally oval ring and a second flap located at the opening at the top of the generally oval ring wherein the opening is a bow-tie shape and wherein the first flap and the second flap are flexible and wherein the first flap and the second flap prevent an earbud from accidentally falling out of the generally u-shaped holder.

11. An earbud holder comprising:

a front panel having a first side, a second side, a top, a bottom, a front and a back;

a back panel having a first side, a second side, a top, a bottom, a front and a back;

a generally u-shaped holder having a first side, a second side and a bottom and an interior and wherein the u-shaped holder is located between the front panel and the back panel;

wherein the front panel moves with respect to the back panel and wherein an earbud is secured within the interior of the u-shaped holder; and a generally oval ring having a top, a bottom, a curved side, a first opening and a second opening wherein the first opening runs between the top, the bottom and the curved side and wherein the second opening is located on the top of the generally oval ring and wherein the generally u-shaped holder is secured within the first opening of the generally oval ring.

12. An earbud holder comprising:

a front panel having a first side, a second side, a top, a bottom, a front and a back;

a back panel having a first side, a second side, a top, a bottom, a front and a back;

a generally u-shaped holder having a first side, a second side and a bottom and an interior and wherein the u-shaped holder is located between the front panel and the back panel;

wherein the front panel moves with respect to the back panel and wherein an earbud is secured within the interior of the u-shaped holder;

a generally oval ring having a top, a bottom, a curved side, a first opening and a second opening wherein the first opening runs between the top, the bottom and the curved side and wherein the second opening is located on the top of the generally oval ring and wherein the generally u-shaped holder is secured within the first opening of the generally oval ring; and a first flap located at the second opening at the top of the generally oval ring and a second flap located at the second opening at the top of the generally oval ring wherein the second opening is a bow-tie shape and wherein the first flap and the second flap are flexible and wherein the first flap and the second flap prevent an earbud from accidentally falling out of the generally u-shaped holder.

* * * * *